US007426897B2

(12) United States Patent
De Baan

(10) Patent No.: US 7,426,897 B2
(45) Date of Patent: Sep. 23, 2008

(54) MOORING APPARATUS

(75) Inventor: Jacob De Baan, Maassluis (NL)

(73) Assignee: Bluewater Energy Services BV, Netherland Antilles ( * ) Notice: Subject to any disclaimer, the term of this patent is extended or adjusted under 35 U.S.C. 154(b) by 625 days.

(21) Appl. No.: 10/662,490

(22) Filed: Sep. 15, 2003

(65) Prior Publication Data

US 2005/0204987 A1 Sep. 22, 2005

(30) Foreign Application Priority Data

Sep. 18, 2002 (GB) ..... 0221698.4

(51) Int. Cl.

| | |
|---|---|
| ***B63B 22/02*** | (2006.01) |
| ***B63B 21/00*** | (2006.01) |
| ***B63B 21/50*** | (2006.01) |
| *B63B 27/34* | (2006.01) |

(52) U.S. Cl. ..... 114/230.1; 114/230.13; 114/230.15; 441/3; 441/4

(58) Field of Classification Search ..... 441/3–5; 114/230.1, 230.15–230.19, 293, 230.13, 114/230.14

See application file for complete search history.

(56) References Cited

U.S. PATENT DOCUMENTS

| | | | | |
|---|---|---|---|---|
| 3,354,479 | A * | 11/1967 | Dickson et al. | 441/5 |
| 3,380,091 | A * | 4/1968 | Saurin et al. | 441/3 |
| 3,479,673 | A * | 11/1969 | Manning | 114/264 |
| 3,668,875 | A | 6/1972 | Sander et al. | |
| 3,741,264 | A * | 6/1973 | Kinoshita | 141/383 |
| 3,841,501 | A | 10/1974 | Heijst | |
| 4,406,333 | A | 9/1983 | Adams | |
| 4,420,276 | A | 12/1983 | Roberts | |
| 4,597,595 | A | 7/1986 | Wallace | |
| 4,639,228 | A | 1/1987 | Bulow | |
| 4,774,903 | A | 10/1988 | Goold et al. | |
| 5,913,279 | A | 6/1999 | Braud et al. | |
| 6,485,343 | B1 * | 11/2002 | Børseth | 441/4 |
| 6,546,739 | B2 * | 4/2003 | Frimm et al. | 62/50.2 |
| 6,915,753 | B1 * | 7/2005 | De Baan | 114/230.14 |
| 7,107,925 | B2 * | 9/2006 | Wille et al. | 114/230.15 |
| 7,114,883 | B2 * | 10/2006 | De Baan | 405/206 |
| 7,182,660 | B2 * | 2/2007 | De Baan | 441/5 |

FOREIGN PATENT DOCUMENTS

| | | |
|---|---|---|
| FR | 1 421 700 | 12/1965 |

(Continued)

*Primary Examiner*—Ajay Vasudeva
(74) *Attorney, Agent, or Firm*—Gary M. Anderson; Fulwider Patton LLP

(57) ABSTRACT

The present invention relates to apparatus for mooring a floating vessel in open sea, using a semi submersible floating dock. The apparatus is particularly suitable for tankers carrying liquid natural gas in cryogenic form which can be a dangerous substance to handle and hence offshore terminals are preferred. The apparatus comprises a semi-submersible floating dock (1) for receiving a vessel (10) and a single point mooring system (5), with a rigid arm (3) between the two. The dock (1) is pivotally connected to the arm (3). The single point mooring system (5) comprises a mooring buoy (17) secured to the seabed by a compliant anchoring system such as a number of catenary anchor legs (15). This allows vertical movement of the mooring buoy (17) but constrains the movement to a relatively small column of water.

10 Claims, 3 Drawing Sheets

FOREIGN PATENT DOCUMENTS

| | | | | |
|---|---|---|---|---|
| FR | 1 465 759 | | | 1/1967 |
| FR | 2579558 | A | * | 10/1986 |
| GB | 2 056 391 | | | 3/1981 |
| GB | 2328196 | A | | 3/1998 |
| GB | 2328196 | A | * | 2/1999 |
| JP | 59179486 | A | | 10/1984 |
| WO | WO 82 01859 | | | 6/1982 |
| WO | WO 98/36153 | | | 8/1998 |
| WO | WO/0027692 | | | 5/2000 |
| WO | WO 02/052150 | | | 7/2002 |

* cited by examiner

MOORING APPARATUS

The present invention relates to apparatus for mooring a floating vessel in open sea, using a semi-submersible floating dock.

There is a fast growing demand for Liquid Natural Gas (LNG) in developed countries and as a result there is an increased need to import LNG into these countries.

Unfortunately, due to the nature of LNG as a cryogenic fluid, i.e. a gas in a cooled liquid form, it is perceived that there are a number of risks associated with its handling. For this reason, it is often difficult to obtain permission for the construction and operation of LNG receiving terminals, particularly in areas that may be densely populated, either at the shore or in harbors.

Alternatively the LNG receiving terminals can be located offshore, away from any populated areas. However, transferring LNG between two offshore structures can pose a number of significant technical difficulties due to the large relative motions that may result between the vessels as a result of wave action acting upon them. Current offloading apparatus does little to reduce the effects of wave action upon two offshore vessels and consequently there is a need for improved fluid transfer apparatus.

It is known to use a submersible dock to transfer fluid from a first vessel to a receiving terminal. Typical arrangements of this sort are disclosed in patent documents GB 2,056,391, U.S. Pat. No. 3,841,501 and FR 1,421,00. However, such arrangements invariably suffer from operational 5 disadvantages.

GB 2,056,391 discloses a submersible dock comprising a frame which is connected via a rigid articulated arm to an anchoring member on the seabed. Being rigidly connected to the sea bed the frame has limited movement in a vertical direction. Consequently, it would be unsuitable for mooring a tanker in heavy seas.

Conversely, U.S. Pat. No. 3,841,501 discloses a submersible dock having a range of movement limited only by the length of the fluid supply line. There are no integral means for mooring the tanker, other than to the submersible dock itself, and so the tanker must instead be moored by attachment to a separate buoy or submerged buoyant body.

There is therefore a need for a loading dock which can overcome these disadvantages and which is able to rigidly moor a vessel yet permit sufficient motion of the mooring means such that fluid transfer between the vessel and the receiving terminal can occur in heavy seas.

The present invention provides apparatus for mooring a partly submerged floating vessel, comprising a floating dock, a single point mooring system and a rigid connecting member connecting the dock to the single point mooring system, wherein the dock is pivotally attached to the connecting member and the single point mooring system is attached to the seabed by a compliant mooring system.

Preferably, the rigid connecting member is pivotally attached to the dock for movement about two mutually perpendicular axes.

Advantageously, the apparatus further comprises at least one thrust producing device mounted to the dock to facilitate movement of the dock relative to the single point mooring system or the stationary earth.

In addition, the floating dock may further comprise variable buoyancy means to raise and lower the level of dock in the water.

Typically, the variable buoyancy means comprises at least one tank, means to admit water to the tank to reduce buoyancy and means to supply gas to the tank to expel water therein in order to increase buoyancy.

The dock may comprise a floor structure engageable against the hull of a vessel arid a plurality of columns projecting upwardly from the floor structure, the columns arranged on either side of the axis to allow a vessel to enter and exit the dock in the same direction.

Preferably, the single point mooring system comprises a floating buoy attached to the seabed by three equi-spaced anchor leg groups to prevent excessive drift of the buoy.

A swivel mechanism may be fitted between the buoy and the anchor leg groups.

Each anchor leg group typically comprises two or more generally parallel anchor legs to provide redundancy.

A winch mechanism is preferably mounted on the single point mooring system, having a winch line attachable to a vessel and operable to facilitate entry of the vessel into the dock.

The apparatus usually further comprises loading means on the dock for loading or unloading contents of a vessel moored in the dock.

In particular, a riser may connect the single point mooring system to a seabed structure, such as a pipeline, and fluid conduits extend from the riser to the dock for transmission of fluid to the loading means.

The present invention also provides a method for mooring a vessel in an offshore environment, utilizing apparatus of the type described above, comprising the steps of aligning the floating dock with the direction of approach of a floating vessel, positioning the vessel within the dock, increasing the buoyancy of the dock to raise the level of the dock in the water until it engages against the underside of the hull of the vessel to suppress differential motion between the vessel and the dock, and loading or unloading material onto or from the vessel.

The present invention will now be described in detail, by way of example only, with reference to the accompanying drawings in which.

Figure 1:
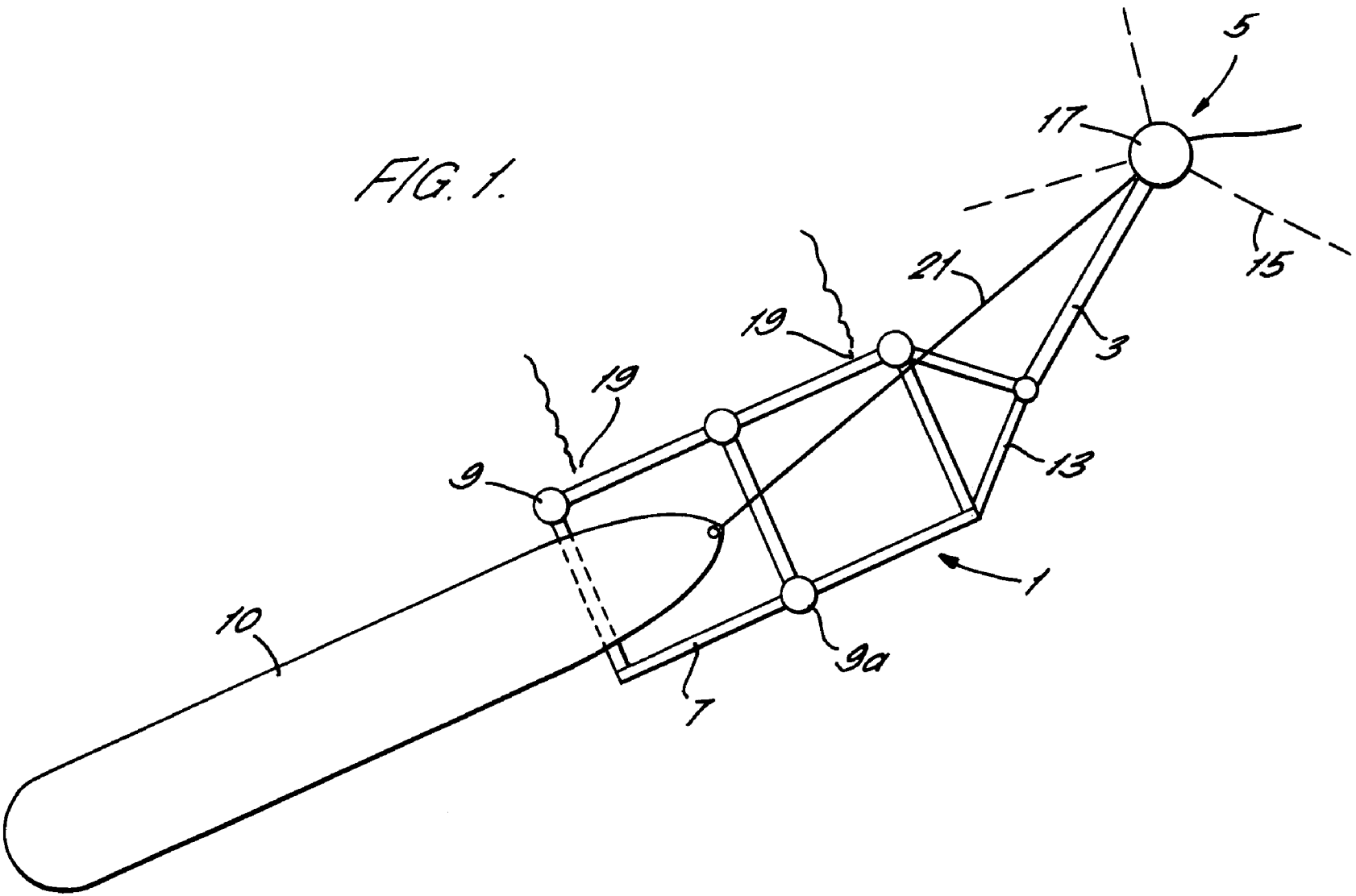
FIG. 1 is a schematic plan view of an embodiment of the present invention illustrating a means for positioning a tanker in a semi-submersible loading dock.

A schematic view of the preferred embodiment of the apparatus according to the present invention can be seen in FIG. 1. A loading dock, shown generally at 1, is attached by a rigid arm 3 to a single point mooring system, shown generally at 5, and a winch line 21 is attached between the single point mooring system 5 and a docking vessel 10.

In cross-section the semi-submersible loading dock 1 is arranged in a U configuration having a generally horizontal loading dock floor 7 supporting generally vertical and perpendicular uprights 9. In order to accommodate relatively slender vessels, and yet provide a large enough floor area to prevent pitching of the vessel 10 within the loading dock 1, it is preferred that the loading dock floor 7 is rectangular in shape, with each of the longer sides oriented in a direction that is generally parallel to the sides of a docking vessel 10.

To provide entry and exit routes for a docking vessel 10 the uprights 9 are located along the long sides of the dock 1 such that the ends of the dock 1 are left open A typical configuration of the loading dock 1 comprises a plurality of uprights 9 along a long side and a single upright 9*a* located on the opposite long side. Structural members linked between the plurality of uprights 9 provide support for any operational equipment. The single upright 9*a* acts as a guide when maneuvering the vessel 10 into the dock 1.

In order to restrain the movement of the loading dock 1 it is attached via a rigid arm 3 to a single point mooring system 5. The rigid arm 3 is rotatably attached to the loading dock floor 7 at the apex of a triangular section 13 which is in turn attached to the short side of the loading dock floor 7 on the exit side of the loading dock 1.

The single point mooring system 5 consists of a mooring buoy 17 secured to the sea bed by a compliant anchoring system, such as a number of catenary anchor legs 15, such that movement of the buoy 17 is restricted within known parameters. This mooring system 5 allows vertical movement of the mooring buoy 17 but constrains this movement to a relatively small column of water.

The rigid arm 3 is attached to the mooring buoy 17 and acts to position the loading dock 1 at a sufficient distance from the single point mooring 5 such that a vessel 10 may be positioned within the loading dock 1 without colliding with the mooring buoy 17.

Figure 2:
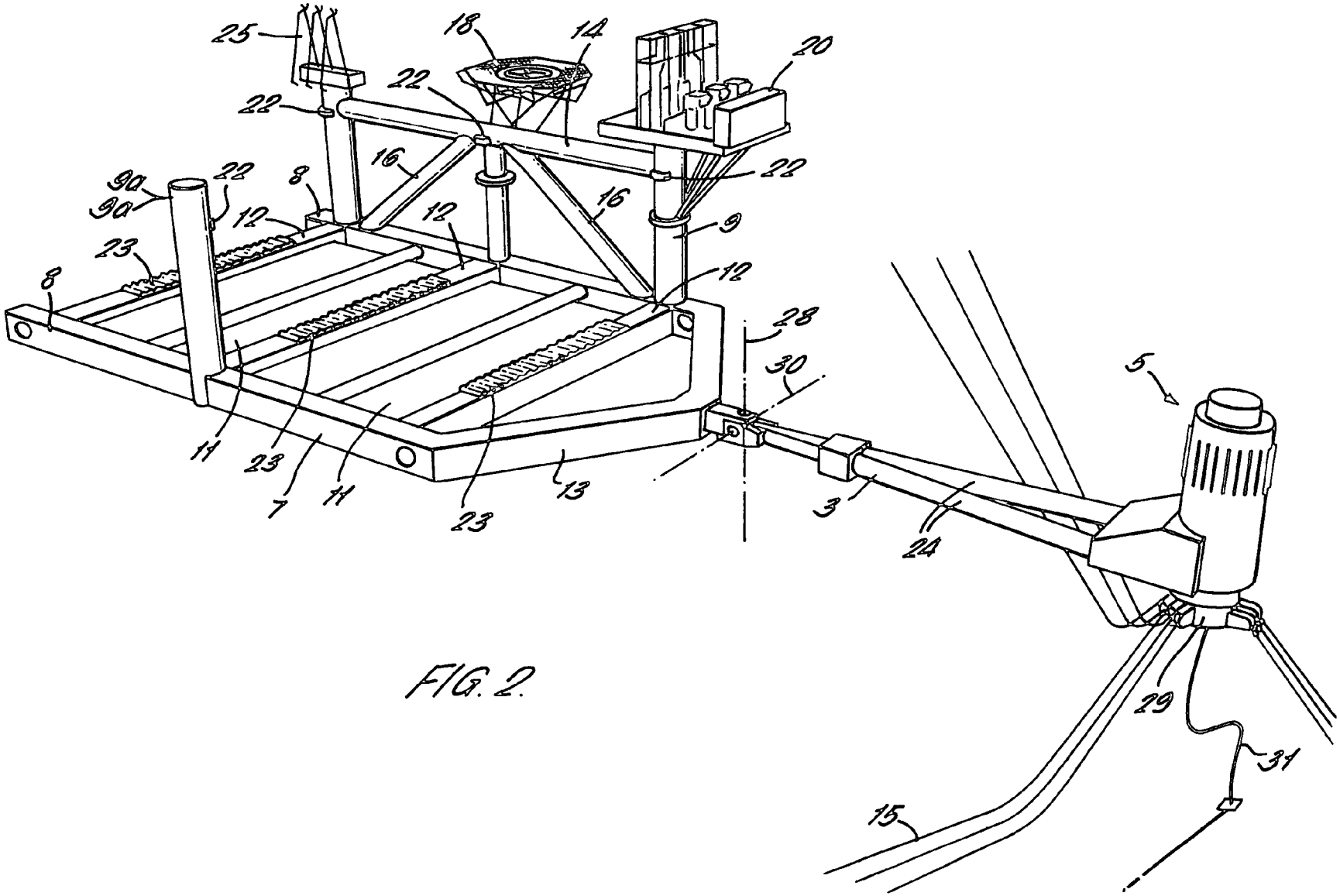
FIG. 2 illustrates in more detail the semi-submersible loading dock of FIG. 1 and a single point mooring system.

The arm 3 typically has two axes of movement at its point of attachment to the loading dock 1, best seen in FIG. 2. The first axis 28 is a substantially vertical axis, generally perpendicular to the loading dock floor 7, enabling the loading dock 1 to rotate relative to the arm 3 in a generally horizontal plane in response to relative movements between the loading dock 1 and the mooring buoy 17, particularly for alignment purposes on the approach of a vessel 10. The second axis 30 is a substantially horizontal axis enabling the arm 3 to pivot in a substantially vertical plane in response to relative displacements between a vessel 10 and the mooring buoy 17.

To aid with the docking of a vessel 10 the apparatus of the present invention is equipped with a plurality of motion inducing devices. For example, thrusters 19, typically attached to the long sides of the loading dock, are used in the preliminary stages to align the long axis of the loading dock 1 with the line of approach of the vessel 10 and during the final stages of docking, to position the loading dock 1 such that contact between the sides of the vessel 10 and the uprights 9 is limited. A winch (not shown) and winch line 21, typically integral to the mooring buoy 17, are provided for attachment to an approaching vessel 10 to further control progress of the vessel 10 into the loading dock.

The apparatus of the present invention will now be described in more detail in reference to FIG. 2.

The loading dock floor 7 is typically constructed from steel box section girders permanently attached together in a single plane in a ladder type configuration. For example, the loading dock floor 7 may have two side beams spaced apart by transverse members. In a preferred embodiment the loading dock floor 7 is constructed from two side beams 8 and three main transverse members 12 and two smaller cross section tubular bracing members 11. In addition, two further members extend from one end of the frame 7 to form a triangular section 13, at the apex of which the arm 3 is attached.

Within these transverse members 12 are contained floatation chambers 23 which enable the buoyancy of the loading dock 1 to be increased or decreased and hence facilitate raising or lowering of the loading dock 1. To decrease buoyancy the floatation chambers 23 are vented to allow egress of air and ingress of water. To increase buoyancy the floatation chambers 23 are vented to permit expulsion of water under the pressure of air supplied to the floatation chambers 23 from a compressed air supply.

When transferring fluid, and in particular cryogenic fluid such as LNG, between two floating structures in an offshore environment it is important that any relative motion between the floating structures is reduced to a minimum. Mooring the structures together in a conventional manner may decrease the relative motion but will not reduce it sufficiently. To achieve the desired reduction in the motion between the vessels it is required that a positive engagement is made between the two floating structures. The apparatus of the present invention achieves positive engagement of the floating structures by using the adjustable buoyancy floatation chambers 23 which are able to force the loading dock floor 7 into contact with the bottom of the hull of the vessel 10 with sufficient upthrust that the loading dock 1 and vessel 10 move in unison.

The uprights 9, 9*a* are preferably cylindrical and extend perpendicularly upwards from the loading dock floor 7 so that they protrude above the surface of the water. Along one of the long sides of the loading dock floor 7 three uprights 9, a horizontal beam 14 and two diagonal braces 16 form a structure which acts as a support for the operational equipment of the loading dock 1. In addition to the features already described the loading dock 1 also comprises fluid transfer means 25, typically LNG loading/unloading equipment, processing equipment, for example a LNG re-gasification plant 20, and operational facilities, for example personnel living quarters and/or a helideck 18.

To prevent damage to the bottom and sides of a docking vessel 10, the loading dock floor 7 and uprights 9 of the loading dock 1 are equipped with fenders 22. The fenders 22 attached to the loading dock floor 7 are also intended to provide additional grip between the loading dock floor 7 and the bottom of the hull and to prevent damage caused by movement between the loading dock floor 7 and the hull of the vessel.

The arm 3 is constructed in a similar way to the loading dock floor 7 having two side beams 24 between which cross members and bracing are positioned. Due to its relatively slender nature it is desirable that the overall mass be kept to a minimum to decrease flexure of the arm 3. At its proximal end the arm 3 is fixed to the apex of the triangular section 13 of loading dock floor 7 by a coupling 27 which allows the arm 3 to rotate about the vertical axis 28 and pivot about the horizontal axis 30 and at its distal end the arm 3 is fixed to the mooring buoy 17.

The mooring buoy 17 is the surface component of the single point mooring system 5 and is attached to the sea bed by anchor legs 15. To further facilitate 15 the movement of the loading dock 1 the mooring buoy 17 is rotatably attached to these anchor legs 15. Attached beneath the anchor legs 15 are attached to this. In the preferred embodiment, there are three anchor legs 15 spaced at approximately 120 degrees from each other. The use of three anchor legs 15, each supplying approximately the same degree of tethering force, helps to limit movement of the buoy 17 within a vertical column of water. Each of the three anchor legs 15 may comprise three individual, and generally parallel, anchor lines. Each of the anchor lines, which are typically anchor chains, are capable of supporting the loads applied to the mooring buoy 17, the additional anchor lines acting as redundant members in case of failure of one or more of the anchor lines.

It is further envisaged that the mooring buoy 17 may support a flexible riser 31 in order to transfer fluid between a subsea pipeline connected to a shoreline and the vessel 10. To connect the fluid transfer means 25 of the loading dock 1 with the flexible riser 31, a further pipeline, which may either be a flexible pipeline or a rigid pipeline having flexible joints, may be run via the arm 3.

Figure 3:
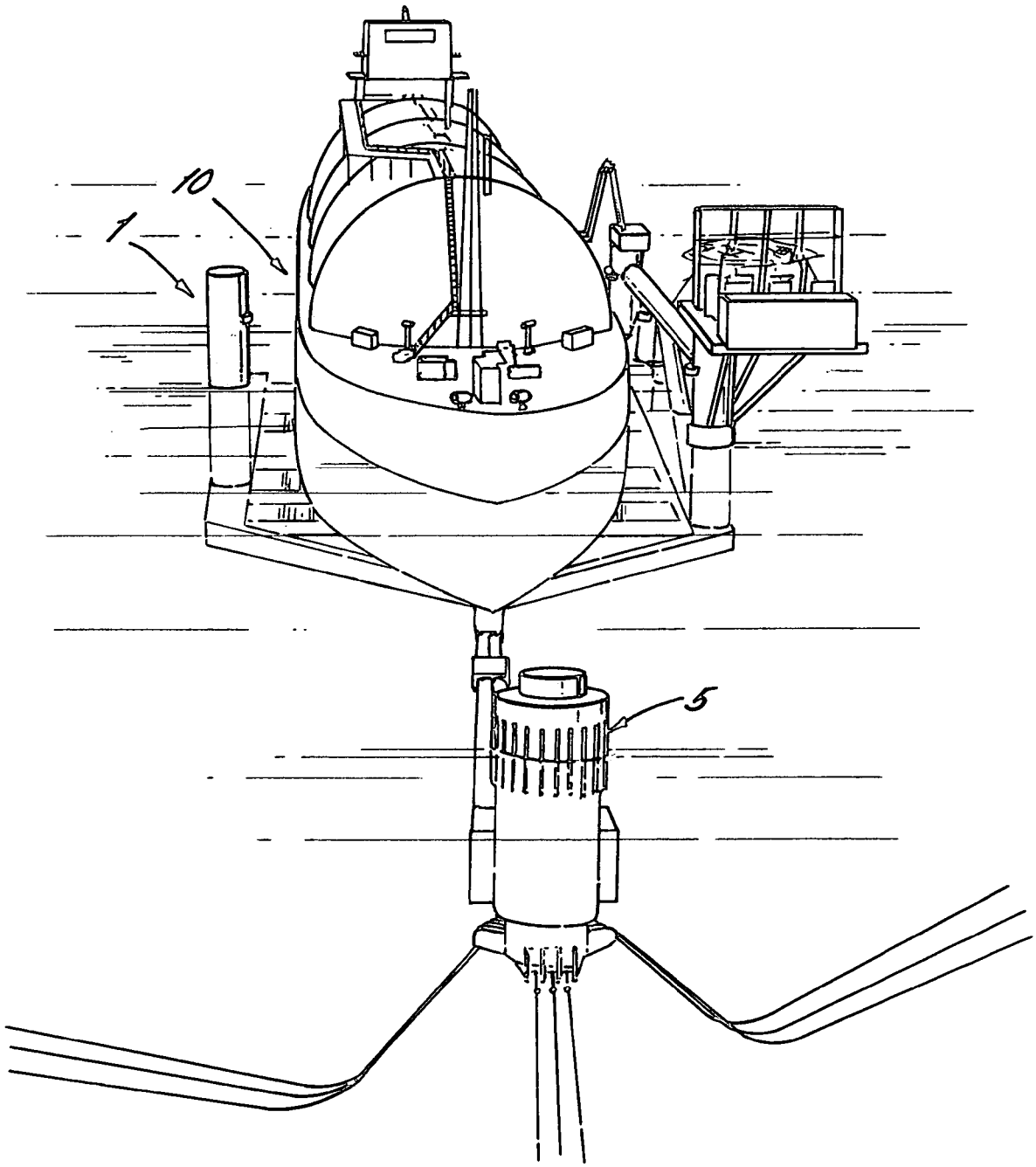
FIG. 3 illustrates a tanker positioned within a semi-submersible loading dock.

FIG. 3 shows a vessel 10, in this case a LNG tanker, in a docked configuration with the loading dock 1. The uprights 9 protrude above the surface of the water to an appropriate height such that fluid transfer means 25 can be extended between the loading dock 1 and the docked vessel 10. The preferred location for the vessel 10 is equidistant the two rows of uprights 9, to reduce any pitching moments. This prevents unnecessary damage being caused by contact between the sides of the hull and the uprights 9 and provides sufficient room in which to maneuver the fluid transfer means 25.

In reference to the plan view of the apparatus shown in FIG. 1 the method of docking a vessel 10 within the loading dock 1 will now be explained.

When the loading dock 1 is empty the floatation tanks are flooded to position it in a semi-submerged state. This serves two purposes. Firstly, it prepares the loading dock 1 to receive a new vessel 10 and secondly it lowers the centre of gravity of the loading dock 1 with respect to the surface of the water and consequently increases its stability.

On the approach of a vessel 10 the loading dock 1 must be maneuvered into a position in which its longitudinal axis is substantially aligned with the longitudinal axis of the vessel 10. In addition, the loading dock 1, the arm 3 and the vessel 10 should be aligned in such a way that once fluid transfer is complete the vessel 10 may exit from the dock in a forwards direction without colliding with the mooring buoy 17. This is shown in FIG. 1 by the angular offset between the arm 3 and the longitudinal axis of the loading dock 1.

Movement of the loading dock 1 is induced by the thrusters 19 located along the sides of the loading dock 1. Control of these thrusters 19 is effected by crew members located upon the loading dock 1. Approach of the vessel 10 to the loading dock 1 is made by the vessel 10 under its own power, however, once the vessel 10 is close to the loading dock 1 a winch line 21 is attached to the bow of the vessel 10 so that the ship can be guided into the loading dock 1 under greater control. The winch line 21 is attached to a winch which is integral with the mooring buoy 17. Connection between the mooring buoy 17 and the docking vessel 10 is achieved using known techniques.

Once the vessel 10 has proceeded through the loading dock 1 to such an extent that the loading dock 1 is positioned approximately midship and the loading/unloading points on the ships are adjacent to the fluid transfer means 25, further progress of the vessel 10 is halted. At this point it is envisaged that securing lines may be attached between the vessel 10 and one or more of the uprights 9 to maintain the position of the vessel 10 within the loading dock 1. Once any such lines have been secured the buoyancy of the floatation tanks is increased, by the addition of compressed air, and the loading dock 1 rises in the water until the hull of the vessel 10 contacts the loading dock floor 7. A measured further increase in the buoyancy of the tanks then acts to ensure contact between the vessel 10 and the loading dock 1 for all sea conditions, thus suppressing differential motion between the dock 1 and the vessel 10. The vertical movement of the loading dock 1 is enabled by pivoting of the arm 3 around the horizontal axis 30. Once the vessel 10 has been docked loading/unloading can be carried out by any conventional and appropriate means.

Once the transfer of fluid is complete and the fluid transfer means 25 has been detached from the vessel 10 the floatation tanks 23 can be flooded and the loading dock floor 7 can be lowered away from the vessel 10 to its default empty position. Any securing lines may now be removed and with the assistance of the mooring buoy 17 winch the vessel 10 may leave the loading dock 1. Use of the thrusters 19 may additionally be required to ensure that contact is not made between the hull and the uprights 9.

The reader will realize that various modifications and variations to the specific embodiments described are also possible without departing from the scope of the claims.

What is claimed is:

1. Apparatus for mooring a floating vessel over a seabed, comprising a semi-submersible floating dock, a single point mooring system and a rigid connecting arm connecting the dock to the single point mooring system, wherein the dock is pivotally attached to the connecting arm and the single point mooring system is attached to the seabed by a compliant anchoring system;

wherein the floating dock further comprises variable buoyancy means to raise and lower the level of the dock in the water; and wherein the dock comprises a floor structure engageable against the hull of a vessel and a plurality of columns projecting upwardly from the floor structure, the columns arranged to allow a vessel to enter and exit the dock in the same direction.

2. Apparatus as claimed in claim 1, wherein the rigid connecting arm is pivotally attached to the dock for movement about two mutually perpendicular axes.

3. Apparatus as claimed in claim 1, further comprising at least one thrust producing device mounted to the dock to facilitate movement of the dock relative to the single point mooring system or the stationary earth.

4. Apparatus as claimed in claim 1, wherein the single point mooring system comprises a floating buoy attached to the seabed by three equi-spaced anchor leg groups.

5. Apparatus as claimed in claim 1 further comprising a winch mechanism mounted on the single point mooring system, having a winch line attachable to a vessel and operable to facilitate entry of the vessel into the dock.

6. Apparatus as claimed in claim 1, further comprising loading means on the dock for loading or unloading contents to or from a vessel moored in the dock.

7. Apparatus as claimed in claim 1, wherein the variable buoyancy means comprises at least one tank, means to admit water to the tank to reduce buoyancy and means to supply gas to the tank to expel water therein in order to increase buoyancy.

8. Apparatus as claimed in claim 1, further comprising a swivel mechanism between the buoy and the anchor leg groups.

9. Apparatus as claimed in claim 1, wherein each anchor leg group comprises two or more generally parallel anchor legs.

10. Apparatus as claimed in claim 9, further comprising a riser for connecting the single point mooring system to a seabed structure and fluid conduits extending from the riser to the dock for loading or unloading contents to or from a vessel moored in the dock.

* * * * *